US008928438B2

(12) United States Patent
Masui et al.

(10) Patent No.: US 8,928,438 B2
(45) Date of Patent: Jan. 6, 2015

(54) ELECTROMAGNETIC RELAY

(71) Applicant: OMRON Corporation, Kyoto-shi, Kyoto (JP)

(72) Inventors: Yasuyuki Masui, Kumamoto (JP); Toshiyuki Kakimoto, Shiga (JP); Tsukasa Yamashita, Kumamoto (JP); Keisuke Yano, Kumamoto (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 0 days.

(21) Appl. No.: 14/167,433

(22) Filed: Jan. 29, 2014

(65) Prior Publication Data

US 2014/0225688 A1 Aug. 14, 2014

(30) Foreign Application Priority Data

Feb. 13, 2013 (JP) ..... 2013-025689

(51) Int. Cl.

| | |
|---|---|
| ***H01H 50/58*** | (2006.01) |
| ***H01F 7/08*** | (2006.01) |
| ***H01F 7/13*** | (2006.01) |
| ***H01H 50/64*** | (2006.01) |

(52) U.S. Cl.

CPC ..... *H01H 50/58* (2013.01); *H01H 50/642* (2013.01)

USPC ..... 335/274; 335/78; 335/275; 335/276

(58) Field of Classification Search

USPC ..... 335/78–86, 274–276

See application file for complete search history.

(56) References Cited

U.S. PATENT DOCUMENTS

| | | | |
|---|---|---|---|
| 7,710,224 | B2 | 5/2010 | Gruner et al. |
| 2003/0112103 | A1 | 6/2003 | Schmelz |
| 2014/0022035 | A1 | 1/2014 | Yamashita et al. |
| 2014/0028418 | A1 | 1/2014 | Yamashita et al. |

FOREIGN PATENT DOCUMENTS

| | | | |
|---|---|---|---|
| DE | 10162585 | C1 | 4/2003 |
| EP | 0237610 | A2 | 9/1987 |
| WO | 2012124164 | A1 | 9/2012 |
| WO | 2012124165 | A1 | 9/2012 |

OTHER PUBLICATIONS

Extended European Search Report for Application No. 14151076.8, mailed on May 26, 2014 (7 pages).

*Primary Examiner* — Ramon Barrera
(74) *Attorney, Agent, or Firm* — Osha Liang LLP

(57) ABSTRACT

An electromagnetic relay has a fixed touch piece having a fixed contact; a movable touch piece, having a movable contact contactably and separably opposed to the fixed contact, and configured to elastically deform, an electromagnet, an intermediate member that rotates based on magnetization and demagnetization of the electromagnet and elastically deforms the movable touch piece, and an energization unit that energizes the movable touch piece to the fixed contact piece side via the intermediate member.

7 Claims, 17 Drawing Sheets

ELECTROMAGNETIC RELAY

BACKGROUND OF THE INVENTION

1. Technical Field

The present invention relates to an electromagnetic relay.

2. Related Art

As a conventional electromagnetic relay, for example, one is known in which three plate springs are superimposed and integrated by fastening and fixing the one end side at three protrusions while fastening and fixing the other end side with a contact, so as to constitute a spring assembly (movable touch piece) (e.g., see U.S. Pat. No. 7,710,224).

However, in the above conventional electromagnetic relay, since the movable touch piece is made up of the three plate springs and those are integrated, in the case of elastically deforming them, it is necessary to act force against elastic force of the three plates. Hence it is necessary to increase driving force generated by a coil assembly (electromagnet) which is used for elastically deforming the movable touch piece. This may cause an increase in the size of the electromagnet or an increase in a current supply amount.

SUMMARY

One or more embodiments of the present invention smoothly drives a movable touch piece with saved power consumption even when one with a large elastic modulus is used as the movable touch piece.

One or more embodiments of the present invention includes: a fixed touch piece having a fixed contact; a movable touch piece, having a movable contact contactably and separably opposed to the fixed contact, and configured to elastically deform; an electromagnet; an intermediate member configured to rotate based on magnetization and demagnetization of the electromagnet and elastically deform the movable touch piece; and an energization unit configured to energize the movable touch piece to the fixed contact piece side via the intermediate member.

Here, the intermediate member refers to a member that serves to transmit driving force, which is generated in association with magnetization and demagnetization of the electromagnet, to the movable touch piece. For example, the intermediate member includes a movable iron piece, a card member and the like.

With this configuration, since the intermediate member is pressed by the energization unit and the movable touch piece is energized to the fixed touch piece side, it is possible to smoothly elastically deform the movable touch piece even at an initial stage when large suction force cannot be acted on the movable iron piece by energizing the electromagnet. Therefore, even when one with a large elastic modulus is used as the movable touch piece, it is not necessary to increase the size of the electromagnet or increase power consumption. Further, even when impact force acts on the electromagnetic relay, since the intermediate member pressed by the energization unit is energizing the movable touch piece, it is excellent in impact resistance and does not give rise to a defect such as deformation of the movable touch piece.

According to one or more embodiments of the present invention, the energization unit is configured so as to no longer perform energization after closing of the contacts.

With this configuration, even when the energization force generated by the energization unit is released after closing of the contacts, it is possible to act suction force generated by the electromagnet on the movable touch piece. Further, it is possible to prevent contact pressure from becoming higher than necessary.

According to one or more embodiments of the present invention, the energization unit is configured so as to perform energization until the movable touch piece elastically deforms up to a predetermined position before closing of the contacts.

With this configuration, since energization force generated by the energization unit does not act on the movable touch piece in the case of demagnetizing the electromagnet, it is possible to smoothly open the contacts by elastic force of the movable touch piece itself. This can result in giving an electromagnetic relay with good operating characteristics.

According to one or more embodiments of the present invention, the electromagnet is formed by winding a coil around an iron core via a spool, fastening and fixing one end of a yoke to one end of the iron core while extending the other end of the yoke to the lateral side of the suction surface of the other end of the iron core, the intermediate member include a sucked portion, rotatably supported by the other end of the yoke and contactably and separably opposed to the suction surface of the iron core, and having a pressure receiving portion, and a pressing portion configured to press the movable touch piece, and the energization unit be made up of a hinge spring fixed to the yoke, and have a press piece configured to press the pressure receiving portion of the intermediate member.

According to one or more embodiments of the present invention, an electromagnet include a spool having a guard portion on each end of a cylindrical body, an iron core inserted through a central hole of the body of the spool, a coil wound on a periphery of the body of the spool, and a yoke with one end thereof fastened and fixed to one end of the iron core and the other end thereof extending to the lateral side of the suction surface of the other end of the iron core, one guard portion of the spool be a suction-side guard portion formed with a groove portion where the suction surface of the iron core is exposed, the intermediate member include a sucked portion, rotatably supported by the other end of the yoke and contactably and separably opposed to the suction surface of the iron core, and a pressing portion configured to press the movable touch piece, and the energization unit be fitted to the suction-side guard portion of the spool, and have a press piece configured to press the sucked portion of the intermediate member located in the groove portion.

With these configurations, just by adding a slight design change to the existing hinge spring and intermediate member, it is possible to easily drive the movable touch piece smoothly, and obtain a configuration excellent in impact resistance.

According to one or more embodiments of the present invention, since the intermediate member is pressed by the energization unit to energize the movable touch piece to the contacts-closed side, it is possible to smoothly elastically deform the movable touch piece without increasing the size of the electromagnet or increasing a current supply amount even when the movable touch piece is one having a large elastic modulus. Further, even when impact force acts, since the movable touch piece is energized by the energization unit via the intermediate member, it is excellent in impact resistance and does not give rise to a defect such as deformation.

DETAILED DESCRIPTION

Hereinafter, embodiments according to the present invention will be described in accordance with accompanying drawing. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. It is to be noted that in the following description, although terms indicating a specific direction or position (e.g., terms including "upper", "lower", "side" or "end") will be used according to the need, the purpose of using these terms is to facilitate understanding of the invention with reference to the drawings, and the meanings of these terms are not intended to restrict the technical scope of the present invention. Further, the following descriptions are merely illustrative, and are not intended to restrict the present invention, applications thereof or the use thereof.

Figure 1:
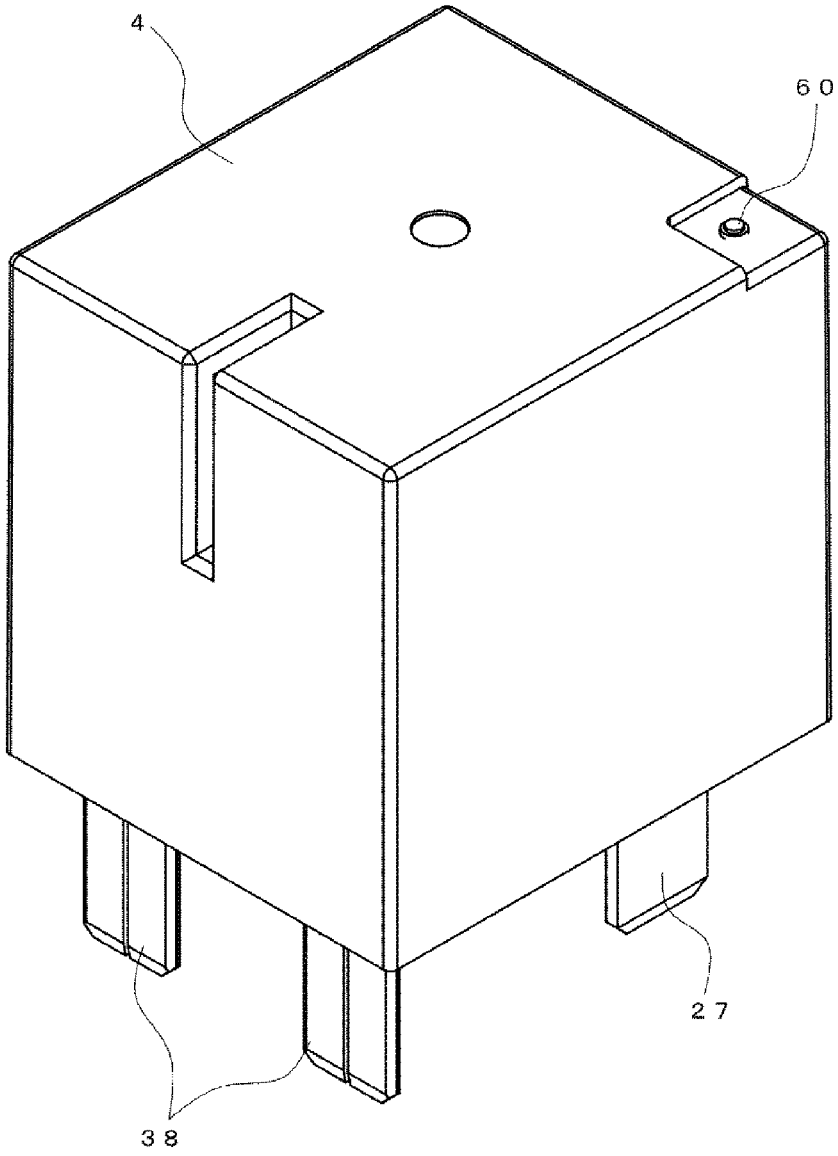
FIG. 1 is a perspective view of an electromagnetic relay according to one or more embodiments of the present invention.
Figure 2:
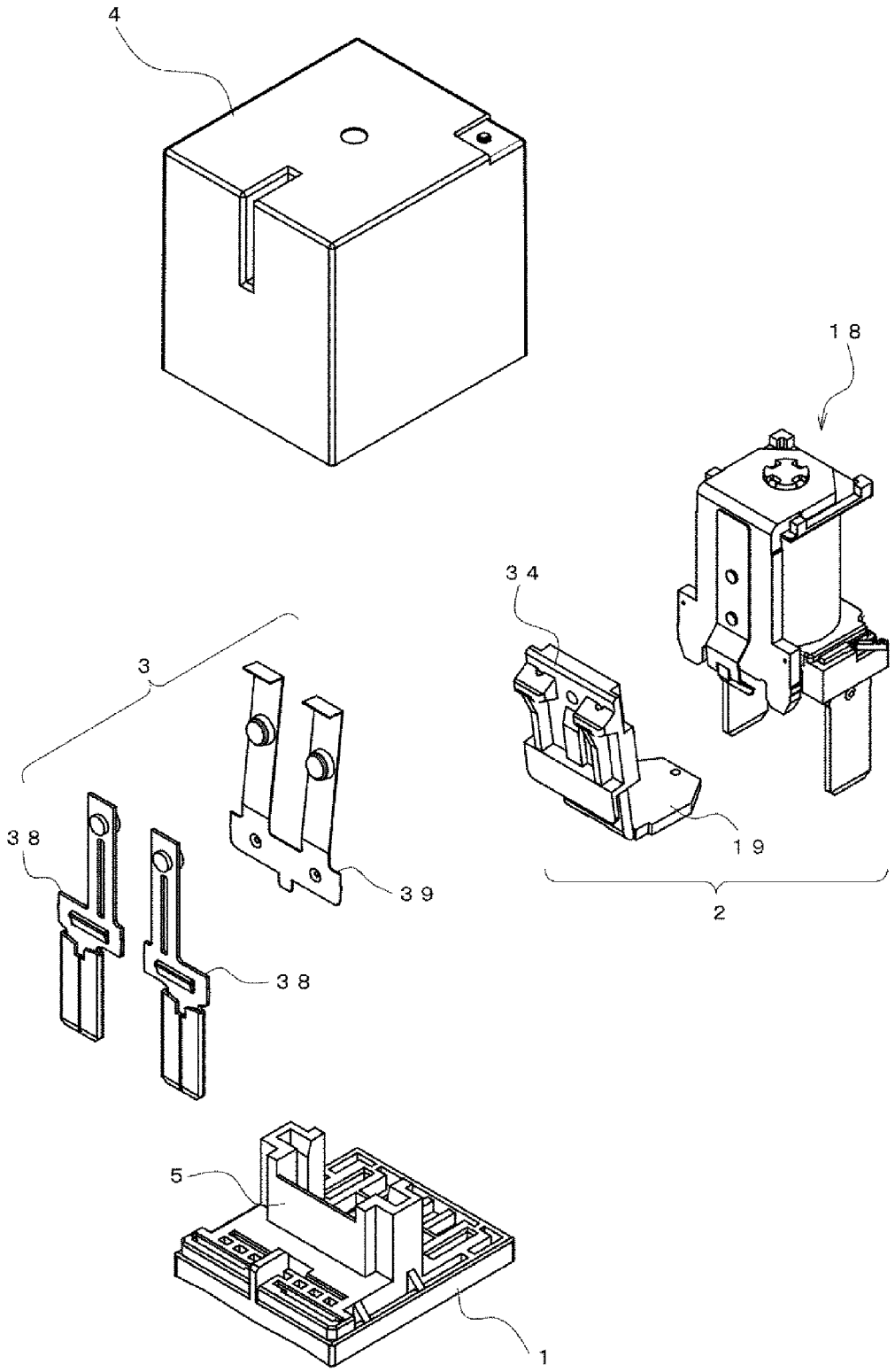
FIG. 2 is an exploded perspective view of FIG. 1.

FIG. 1 is a perspective view showing an appearance of an electromagnetic relay according to one or more embodiments of the present invention, and FIG. 2 is an exploded perspective view thereof. This electromagnetic relay is schematically made up of a base 1, an electromagnet portion 2, a contact switch portion 3, and a casing 4.

Figure 3:
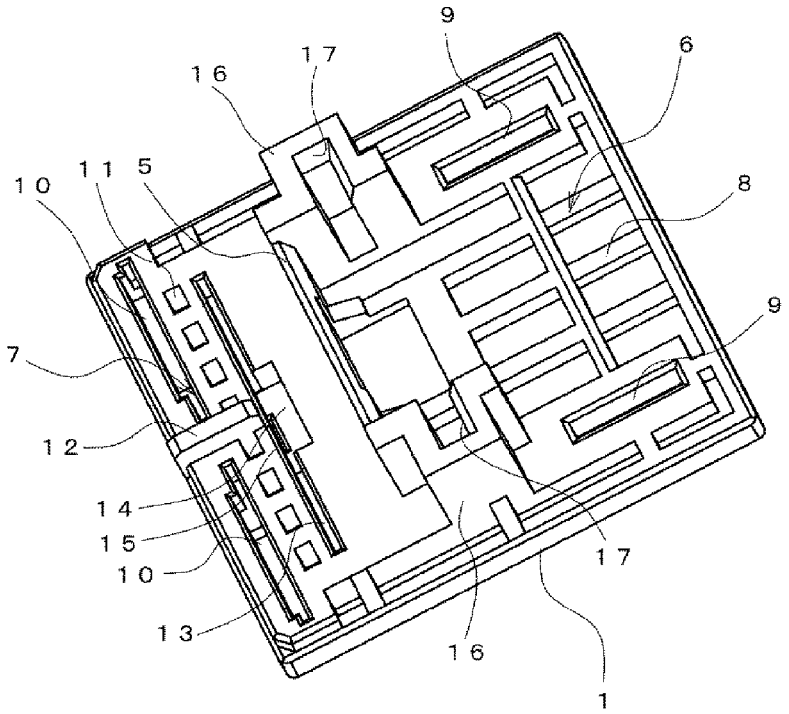
FIG. 3 is a perspective view of a base of FIG. 2.

As shown in FIG. 2, and specifically shown in FIG. 3, the base 1 is one formed by molding a synthetic resin material into a plate shape. A central portion on the upper surface of the base 1 is provided with a partition wall 5, to divide the base 1 into two portions: a first mounting portion 6 to be arranged with the electromagnet portion 2; and a second mounting portion 7 to be arranged with the contact switch portion 3.

A central part on the upper surface of the first mounting portion 6 is formed with a lattice-like rib 8 by a plurality of recessed portions having a rectangular shape in a plan view. Further, each side of the first mounting portion 6 is formed with a coil terminal hole 9 having a rectangular shape in a plan view and penetrating between the upper and lower surfaces.

The second mounting portion 7 is formed with fixed terminal holes 10 penetrating between the upper and lower surfaces respectively in two places in a width direction along one end surface. Further, a plurality of recessed portions 11 are formed along the fixed terminal holes 10. The fixed terminal holes 10 and the recessed portions 11 are separated by an auxiliary wall 12 at the center. Further, a fitting recessed portion 13 extending in the width direction is formed adjacent to the plurality of recessed portions 11. The fitting recessed portion 13 has in the central portion thereof an escape recessed portion 14 extending to the other end side. A central portion on the bottom surface of the escape recessed portion 14 is formed with an aligning hole 15 penetrating to the lower surface.

Each side of the partition wall 5 is formed with a guide portion 16 protruding more than this partition wall 5. Each guide portion 16 is formed with a guide groove 17 extending to the opposed surface in a vertical direction.

The electromagnet portion 2 is made up of an electromagnet 18 and a movable iron piece 19 driven by this electromagnet 18.

Figure 4:
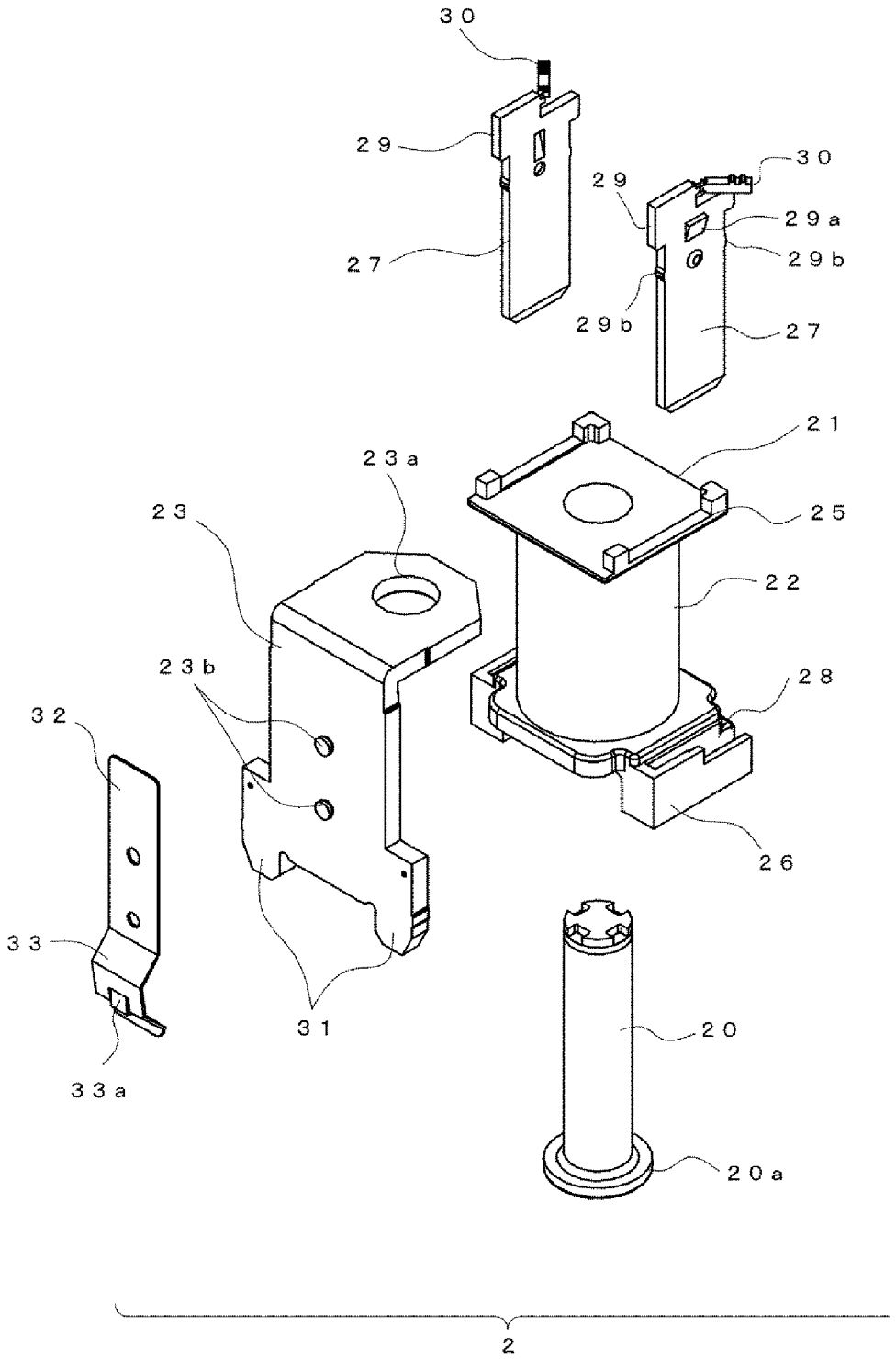
FIG. 4 is an exploded perspective view of an electromagnet of FIG. 2.

As shown in FIG. 4, the electromagnet 18 is one obtained by winding a coil 22 around an iron core 20 via a spool 21.

The iron core 20 is one formed of a magnetic material into a cylindrical shape. The lower end of the iron core 20 is formed with a guard portion 20*a*, and the lower surface thereof is a suction surface 20*b* (cf. FIG. 10). A yoke 23 is fastened and fixed to the upper end of the iron core 20.

The spool 21 is one obtained by molding a synthetic resin material into a substantially cylindrical shape. The coil 22 is wound around a body 24 (cf. FIG. 10) of the spool 21. Each end of the spool 21 is formed with a guard portion. The upper surface of an upper-end-side guard portion 25 is formed with a groove portion where a horizontal portion of the yoke 23 is to be arranged. The lower surface of a lower-side guard portion 26 is formed with a groove portion where a later-mentioned horizontal portion 19*a* of the movable iron piece 19 is to be arranged. Further, each side of the lower-side guard portion 26 is formed with a coil press-fitting hole 28 where a coil terminal 27 is to be press-fitted.

The coil terminal 27 is made of a metallic plate member having conductivity, and the upper end part thereof is formed with a wide portion 29. Part of the wide portion 29 is cut and raised, to become a winding portion 30 where a leader line of the coil 22 is to be wound. The central part on the side surface of the wide portion 29 is formed with a protrusion 29*a*. Further, each side portion of the coil terminal 27 is formed with a protrusion 29*b* protruding to the lateral side in the vicinity of the wide portion 29. At the time of inserting the coil terminal 27 into the coil press-fitting hole 28 formed in the lower-side guard portion 26 of the spool 21, these protrusions 29*a*, 29*b* come into a press-fitted state, to align the coil terminal 27 with respect to the spool 21.

The yoke 23 is one formed by bending a plate member made of a magnetic material is bent into a substantially L-shape. A central part of a horizontal portion thereof is formed with a through hole 23*a*. The upper end of the iron core 20 is inserted into the through hole 23*a* and fastened. In this fastened state, a vertical portion of the yoke 23 extends to the lower end side along the coil 22 wound around the spool 21. Each side of the lower end of the vertical portion is a press-fitting portion 31 protruding to the lateral side and to the lower side. The press-fitting portion 31 is press-fitted into the groove 17 formed in the guide portion 16 of the base 1, to align the yoke 23, namely the electromagnet 18, with respect to the base 1. Further, fastening protrusions 23*b* are formed in two (upper and lower) places on the outer surface of the vertical portion. A hinge spring 32 is fastened and fixed to the yoke 23 through use of these protrusions 23*b*.

The hinge spring 32 is a platy body having elasticity, and the lower end of which is formed with a substantially C-shaped flexing portion 33. This flexing portion 33 elastically supports the movable iron piece 19 between itself and the lower end of the yoke 23. This can make the movable iron piece 19 rotatable around the lower end (specifically a left-side corner in FIG. 10) of the yoke 23. Further, as shown in FIG. 5B, a press piece 33*a* is cut and raised in the central portion of the flexing portion 33. The press piece 33*a* is flexed in an intermediate part, and the leading end portion thereof is a press portion 33*b*. The press portion 33*b* comes into press-contact with a later-mentioned pressure receiving surface 19*e* obtained by forming a recessed portion 19*d* in the flexing portion of the movable iron piece 19.

Figure 5A:
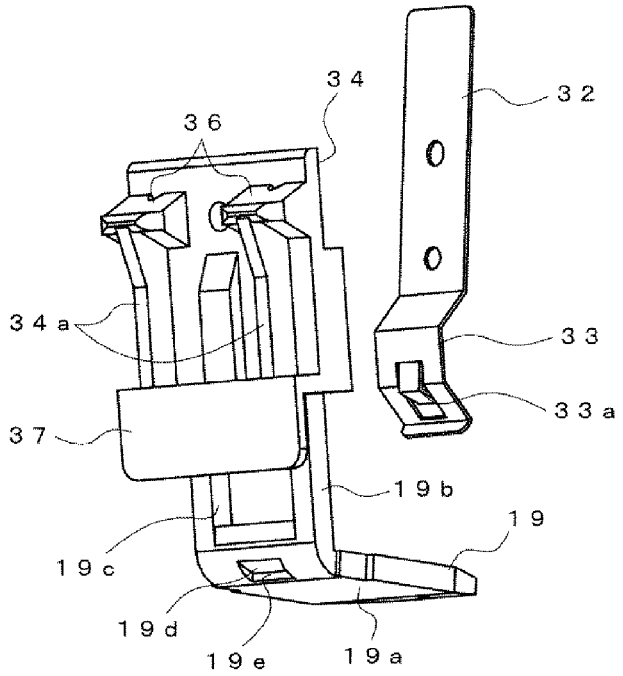
FIG. 5A is an enlarged perspective view of a movable iron piece, a card member and a hinge spring of FIG. 2.
Figure 5B:
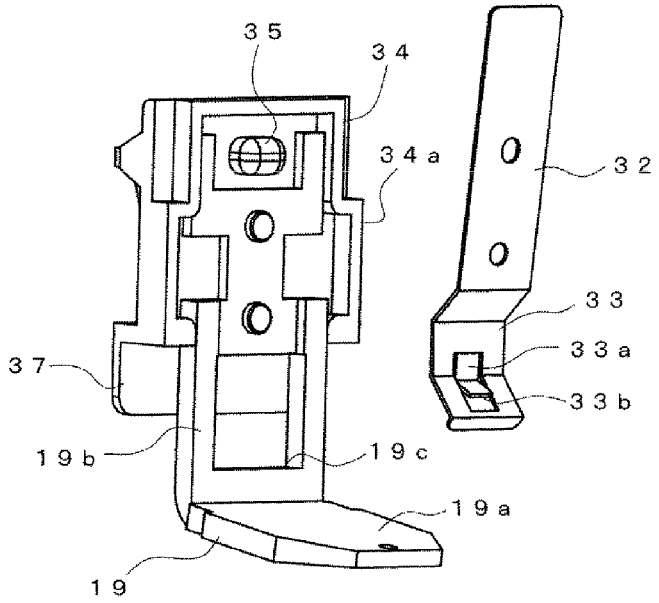
FIG. 5B is a perspective view showing a state of FIG. 5A as seen from a different angle.

As shown in FIG. 5, the movable iron piece 19 is made of a plate member of a magnetic material, and flexed in an intermediate part, to have a substantially L-shape. The horizontal portion 19*a* obtained by the flexing is sucked to the suction surface 20*b* of the iron core 20. The horizontal portion 19*a* on the base side (a boundary part with the vertical portion 19*b*) is formed with the recessed portion 19*d* having the pressure receiving surface 19*e*, with which the press portion 33*b* of the hinge spring 32 is to come into contact. Meanwhile, the vertical portion 19*b* is formed with a rectangular hole 19*c*, though which the flexing portion 33 of the hinge spring 32 is to be inserted. Further, the vertical portion 19*b* is formed with through holes (not shown) for integration with a card member 34 in two places in the above part of the rectangular hole 19*c*.

The movable iron piece 19 is integrated with the card member 34 by insertion molding (or may be integrated not by insertion molding but by thermal fastening or the like). The card member 34 is one formed of a synthetic resin material into the plate shape. The rear surface thereof comes into contact with the vertical portion 19*b* of the movable iron piece 19, and projected threads 34*a* are formed on peripheral three sides so as to surround this vertical portion 19*b*. Further, the rear surface of the card member 34 is formed with a protrusion portion 35 protruding to the rear surface side via a notch formed in the upper part of the vertical portion of the movable iron piece 19. This protrusion portion 35 comes into contact with the hinge spring 32 fastened and fixed to the yoke 23, to restrict the range of rotation in this direction. On the other hand, the front surface of the card member 34 is formed with the projected threads 34*a* vertically extending on two rows in the width direction, and the upper end part of each projected thread 34*a* is formed with a pressing portion 36 protruding to the front surface side. The lower end of the card member 34 is formed with a guide piece portion 37 protruding forward and then flexed downward. The guide piece portion 37 is arranged on the second mounting portion 7 side over the partition wall 5 of the base 1.

The contact switch portion 3 is made up of a pair of fixed touch pieces 38 and a movable touch piece 39.

Figure 7:
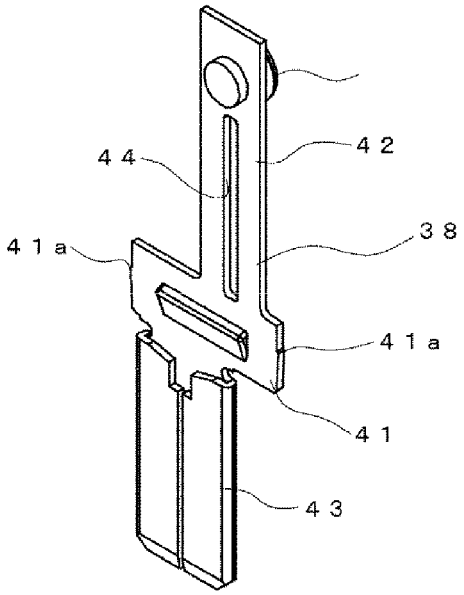
FIG. 7 is an enlarged perspective view of a fixed touch piece of FIG. 2.

As shown in FIG. 7, the fixed touch piece 38 is one formed of a metallic material having conductivity into the plate shape. The fixed touch piece 38 is made up of a press-fitting portion 41 to be press-fitted into the fixed terminal hole 10 formed in the base 1, a touch piece portion 42 extending upward from the press-fitting portion 41, and a terminal portion 43 extending to the lower side from the press-fitting portion 41. One surface of the press-fitting portion 41 is formed with a protrusion portion 41*a* extending in the width direction. The touch piece portion 42 is formed with a slit 44 vertically extending in a central position. Further, a fixed contact 45 is fastened and fixed to the upper end of the touch piece portion 42. Moreover, the terminal portion 43 is folded from both sides.

Figure 8:
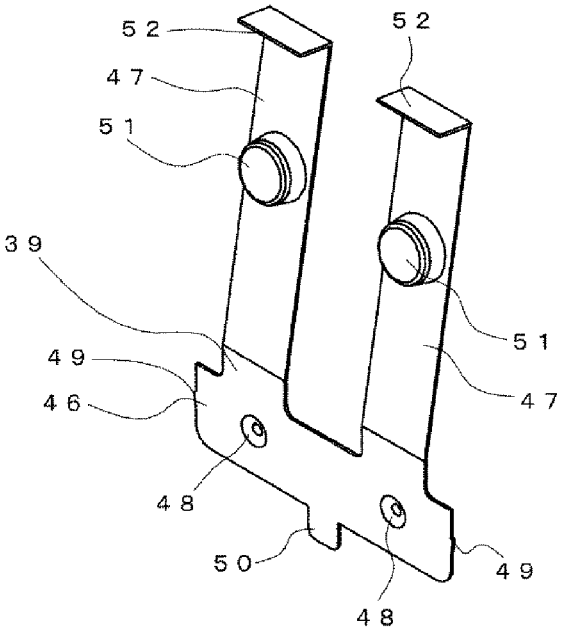
FIG. 8 is an enlarged perspective view of a movable touch piece of FIG. 2.

As shown in FIG. 8, the movable touch piece 39 is one formed of a metallic material having conductivity and elasticity into the plate shape. The movable touch piece 39 is made up of a press-fitting portion 46 and a pair of body portions 47 respectively extending from both sides of the press-fitting portion 46 to the upper side. The press-fitting portion 46 is formed with a pair of protrusions 48, which bulge in a plate thickness direction, at a predetermined interval in the width direction (in FIG. 7, only the recessed portion side for forming the protrusions 48 is shown). Each end of the press-fitting portion 46 further extends to the lateral side, and a latching pawl 49 is protruding from the side edge thereof. Further, a central portion at the lower edge of the press-fitting portion 46 is formed with a press-fitting piece 50 further extending downward. Each of the body portions 47 is flexed in the vicinity part of the press-fitting portion 46 and extends, and the upper end of the body portion 47 is formed with a through hole, where a movable contact 51 is fastened and fixed. Further, the upper end of the body portion 47 is formed with an extended portion 52 which is flexed obliquely upward to the fixed touch piece side.

Figure 9:
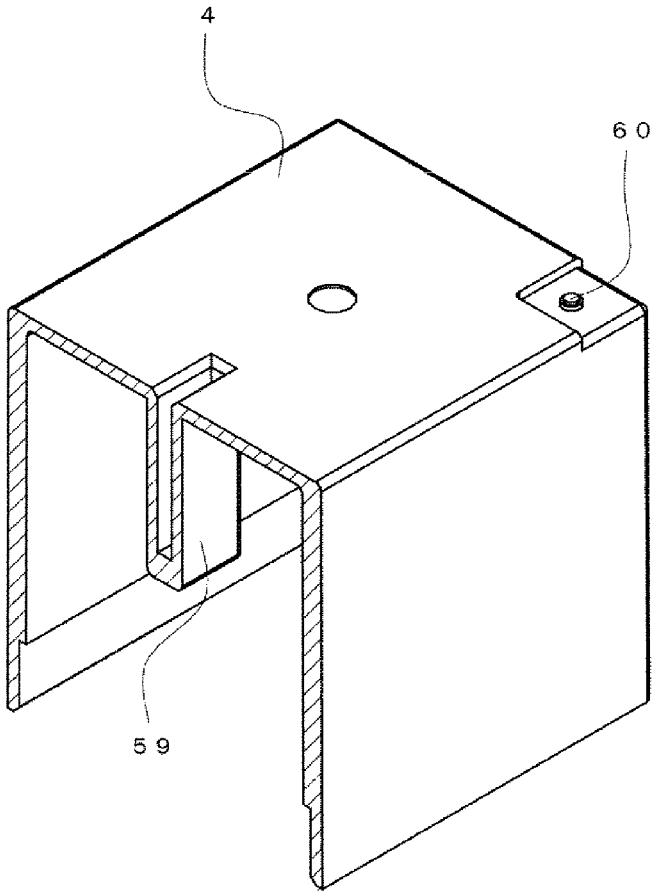
FIG. 9 is a partially ruptured perspective view of a casing shown in FIG. 1.

As shown in FIG. 9, the casing 4 is one obtained by molding a synthetic resin material into the shape of a bottom-open box. The lower-end-side opening of the casing 4 is fitted with the outer side surface of the base 1, thereby to be fixed to the base 1 and cover each component mounted on the base 1. Numeral 59 denotes a separation wall to separate a pair of contact switch parts. Numeral 60 denotes a protrusion which is removed after completion of the electromagnetic relay to form a degassing hole communicating between the inside and the outside. However, this protrusion 60 may not be removed and used as it remains in the sealed state.

Subsequently, an assembly method for the electromagnetic relay with the above configuration will be described.

The coil 22 is wound around the body 24 of the spool 21 and the iron core 20 is inserted through the central hole thereof from the lower side. The coil terminal 27 is press-fitted into the press-fitting hole. In this state, the suction surface 20*b* of the iron core 20 is exposed on the lower surface of the lower-end-side guard portion of the spool 21. Further, the upper end of the iron core 20 protruding from the upper-end-side guard portion 25 of the spool 21 is inserted into a through hole of the yoke 23, and fastened and fixed. The yoke 23 is previously fastened and fixed with the hinge spring 32. Here, the leader line of the coil 22 is wound around the winding portion 30 of the coil terminal 27 and soldered, and thereafter the winding portion 30 is bent along the wound coil 22. This leads to completion of the electromagnet 18.

Figure 6:
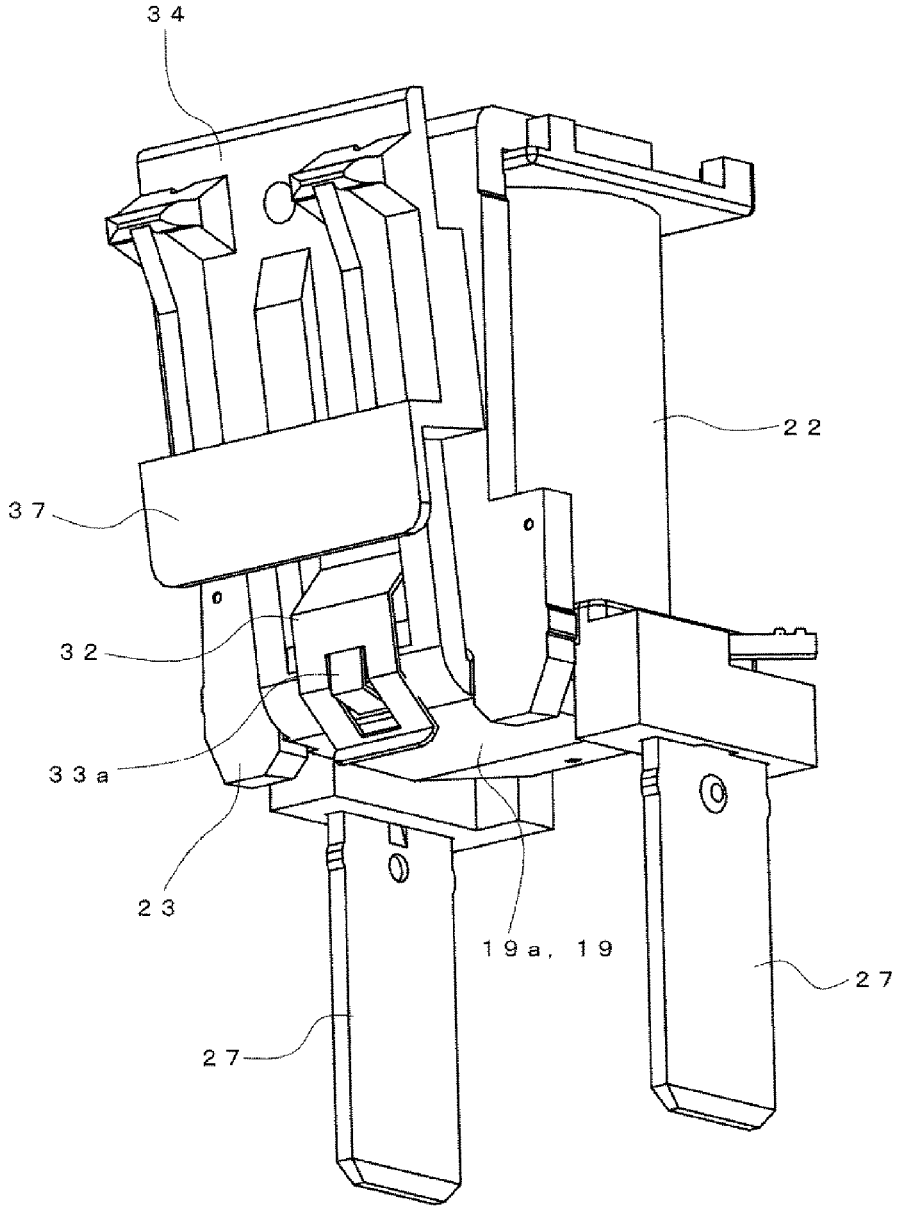
FIG. 6 is a perspective view of an electromagnet portion of FIG. 2 in an assembled state as seen from a different angle.

The movable iron piece 19 is fitted to the completed electromagnet 18. In this fitting, the flexing portion 33 of the hinge spring 32 is inserted through the rectangular hole 19*c* of the movable iron piece 19, and the movable iron piece 19 previously integrated with the card member 34 is elastically supported between the flexing portion 33 and the lower end of the yoke 23. At this time, the leading end of the press piece 33*a* formed in the flexing portion 33 is brought into contact with the pressure receiving surface 19*e* of the recessed portion 19*d* formed in the movable iron piece 19. In this state, as shown in FIG. 6, elastic force of the press piece 33*a* acts on the movable iron piece 19, and the movable iron piece 19 is energized such that the horizontal portion 19*a* moves to the suction surface 20*b* side of the iron core 20 around a fulcrum (the lower end of the yoke 23).

The electromagnet 18 assembled with the movable iron piece 19 in such a manner is mounted on the first mounting portion 6 of the base 1. That is, the coil terminal 27 is press-fitted into the coil terminal hole 9 of the base 1, and the press-fitting portion 31 of the yoke 23 is press-fitted into the guide groove 17 formed in the guide portion 16.

Further, the second mounting portion 7 of the base 1 is mounted with the contact switch portion 3. That is, the terminal portion 43 of the fixed touch piece 38 is press-fitted into the fixed terminal hole 10 from the upper surface side of the base 1, and this terminal portion 43 is protruded from the lower surface of the base 1. Moreover, the movable touch piece 39 is press-fitted into the fitting recessed portion 13.

In the contact switch portion 3 mounted on the base 1 in such a manner, the movable touch piece 39 elastically deforms so as to separate the movable contact 51 from the fixed contact 45 by elastic force of its own. Then, the upper side of the body portion 47 of the movable touch piece 39 rotates the movable iron piece 19 integrated with the card member 34 via the pressing portion 36 of this card member 34. In this state, force acts from the movable iron piece 19 having received energization force of the press piece 33*a* of the hinge spring 32 so as to cancel part of energization force generated by the body portion 47 of the movable touch piece 39.

Finally, the base 1 is covered with the casing 4, to complete the electromagnetic relay.

Next, an operation of the electromagnetic relay with the above configuration will be described.

Figure 10A:
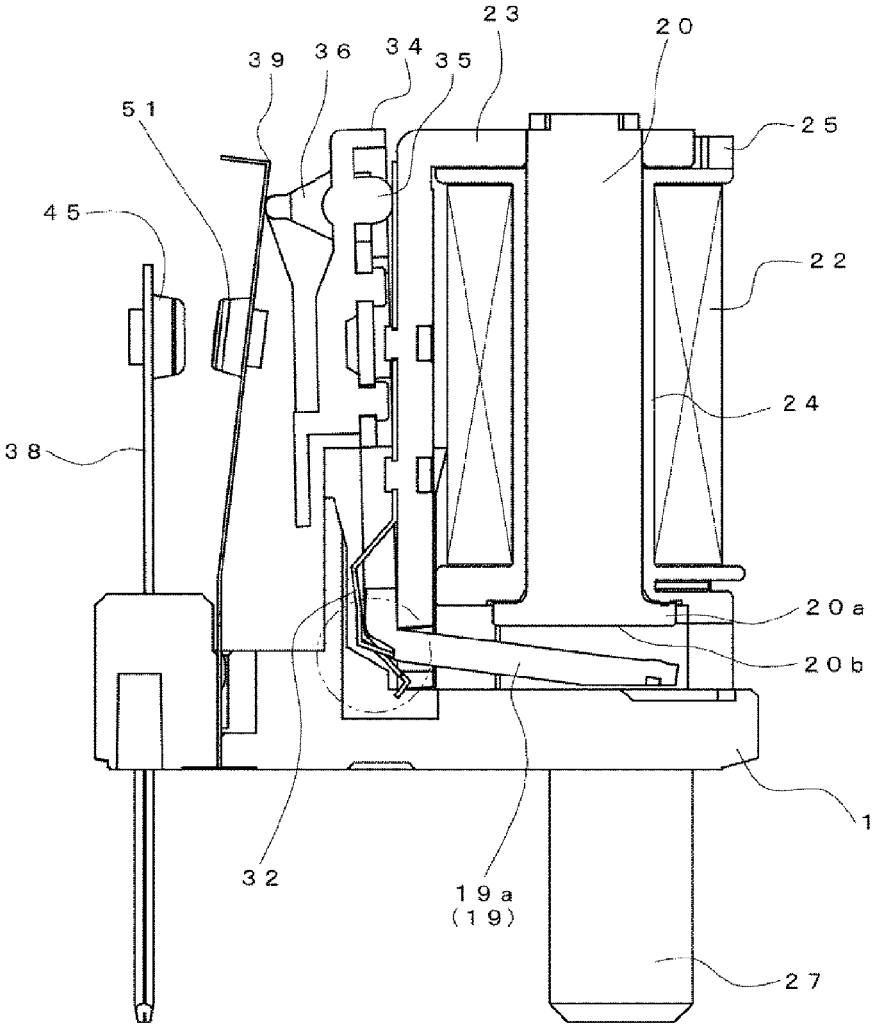
FIG. 10A is a front view of the electromagnetic relay shown in FIG. 1, from which the casing has been removed, with the electromagnet being in a non-magnetized state.
Figure 10B:
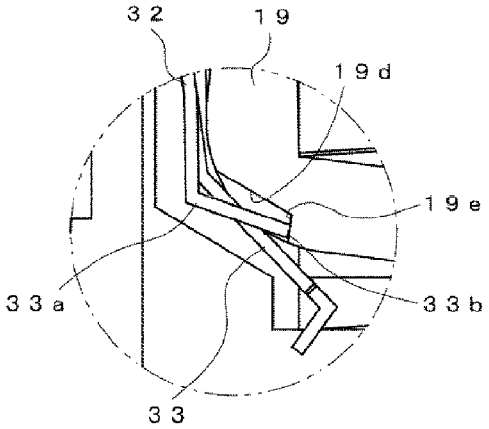
FIG. 10B is a partially enlarged view of FIG. 10A.

With the electromagnet 18 in the demagnetizing state where a voltage is not applied to the coil 22, as shown in FIG. 10, the movable touch piece 39 is located in a position to separate the movable contact 51 from the fixed contact 45 by the elastic force of its own. Further, the movable iron piece 19 is rotated via the pressing portion 36 of the card member 34. That is, the movable iron piece 19 rotates clockwise around the lower edge of the yoke 23, and the horizontal portion 19*a* is held in the state of being separated from the suction surface 20*b* of the iron core 20 of the electromagnet 18.

When a voltage is applied to the coil 22 to magnetize the electromagnet 18, magnetic force acts from the suction surface 20*b* of the iron core 20 on the horizontal portion 19*a* of the movable iron piece 19. In this case, although the elastic force is acting from the movable touch piece 39 on the movable iron piece 19 via the pressing portion 36 of the card member 34, elastic force is acting from the press piece 33*a* of the hinge spring 32 so as to cancel this energization force.

Figure 13:
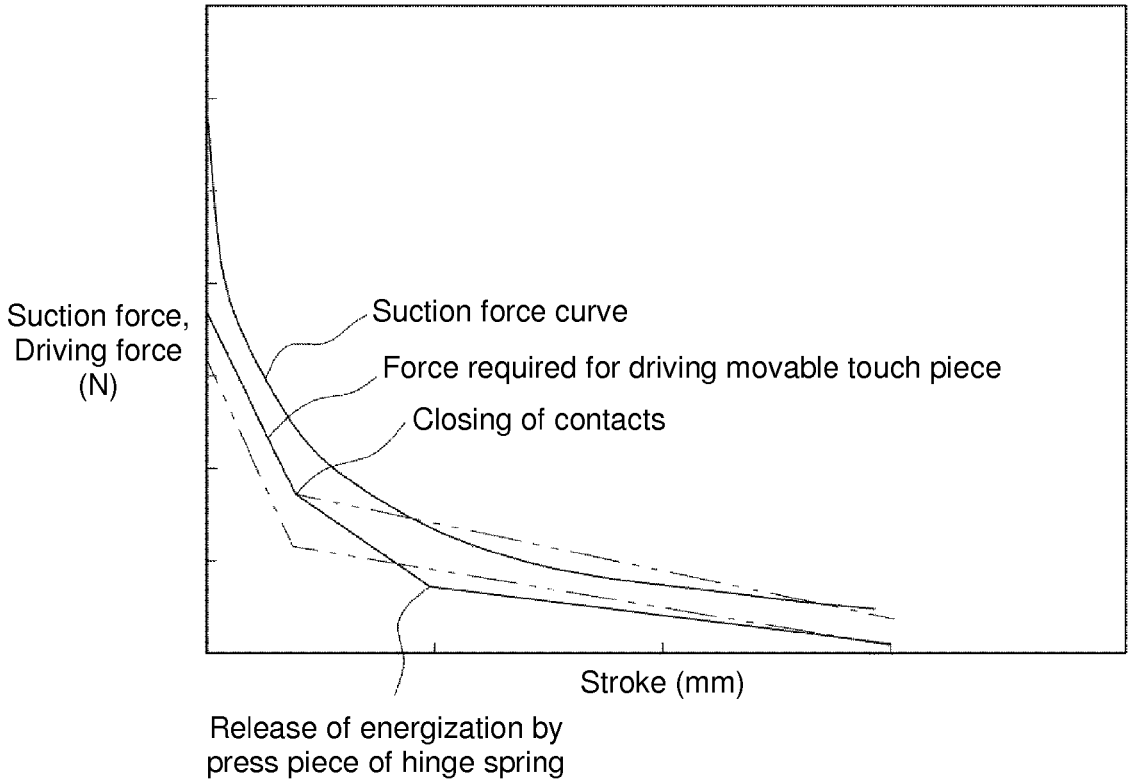
FIG. 13 is a graph showing the relation between a suction force curve and force (driving force) that acts on the movable touch piece.

Specifically, as shown in a graph of FIG. 13, with respect to a curve of suction force which can be acted on the movable iron piece 19 by the electromagnet 18, force (driving force) required for driving the movable touch piece 39 can be changed at two stages by utilizing the energization force of the press piece 33*a* of the hinge spring 32.

Figure 14:
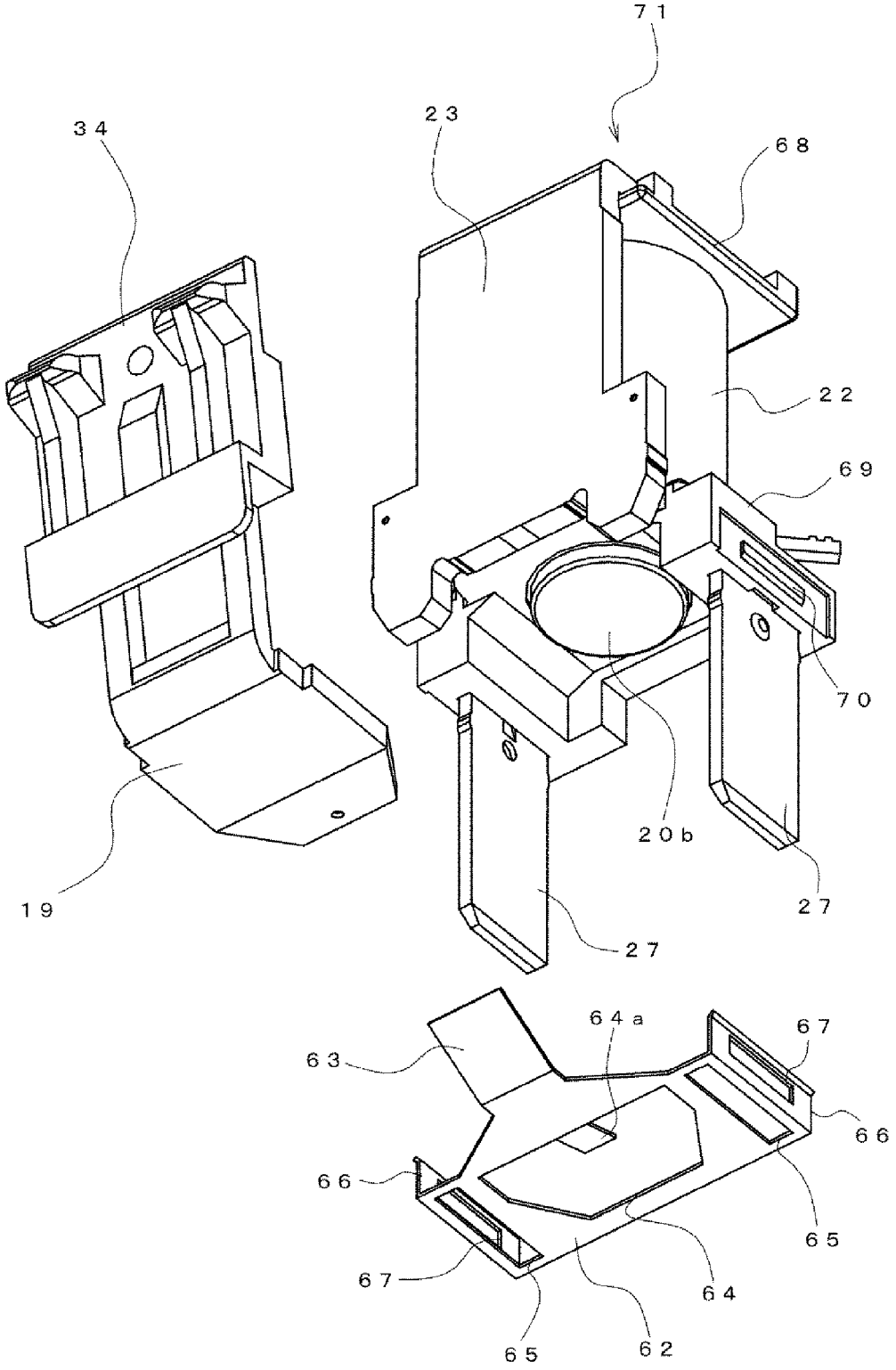
FIG. 14 is a perspective view showing a state of an electromagnet portion and a hinge spring according to one or more embodiments of the present invention as seen from the lower side.

First, until the energization force generated by the press piece 33*a* of the hinge spring 32 is released (initial driving period: cf. FIG. 10), force (driving force) required for elastically deforming the movable touch piece 39 gently changes as shown in a solid straight line (a) in FIG. 14. This is because the elastic force generated by the press piece 33*a* of the hinge spring 32 is acting against the elastic force of the movable touch piece 39 so as to cancel this. Accordingly, it is possible to suppress the driving force to be small at the initial stage where the horizontal portion 19*a* of the movable iron piece 19 is apart from the suction surface 20*b* of the iron core 20, sufficient suction force cannot be acted on the horizontal portion 19*a* of the movable iron piece 19, and the suction force curve gently changes.

Figure 11A:
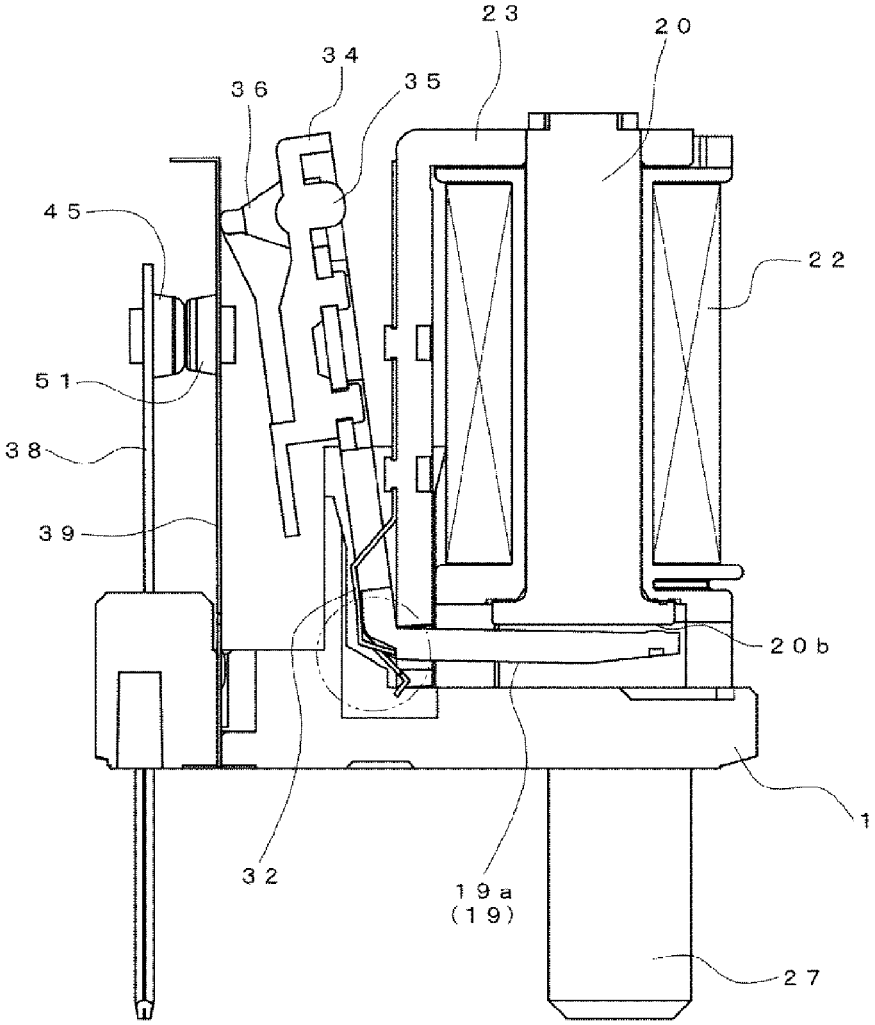
FIG. 11A is a front view showing a state before closing of contacts where the electromagnet has been magnetized from the state of FIG. 10.
Figure 11B:
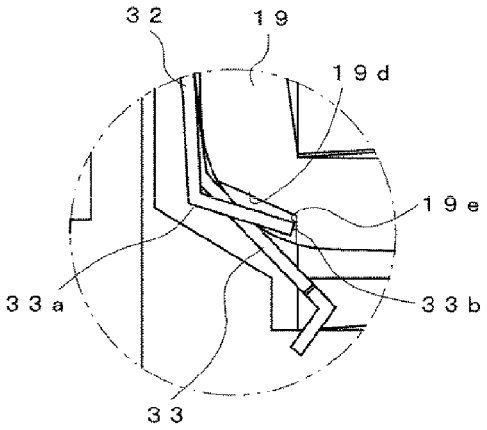
FIG. 11B is a partially enlarged view of FIG. 11A.

Subsequently, when the movable touch piece 39 is driven and the energization force generated by the press piece 33*a* of the hinge spring 32 ceases to act (intermediate driving period: cf. FIG. 11), it becomes necessary to rotate the movable iron piece 19 against the elastic force of the movable touch piece 39, and the driving force thus increases. However, sufficient suction force can be acted due to the horizontal portion 19*a* of the movable iron piece 19 being close to the suction surface 20*b* of the iron core 20. Hence it is possible to drive the movable touch piece 39 even when the energization force generated by the press piece 33*a* of the hinge spring 32 is lost.

Figure 12A:
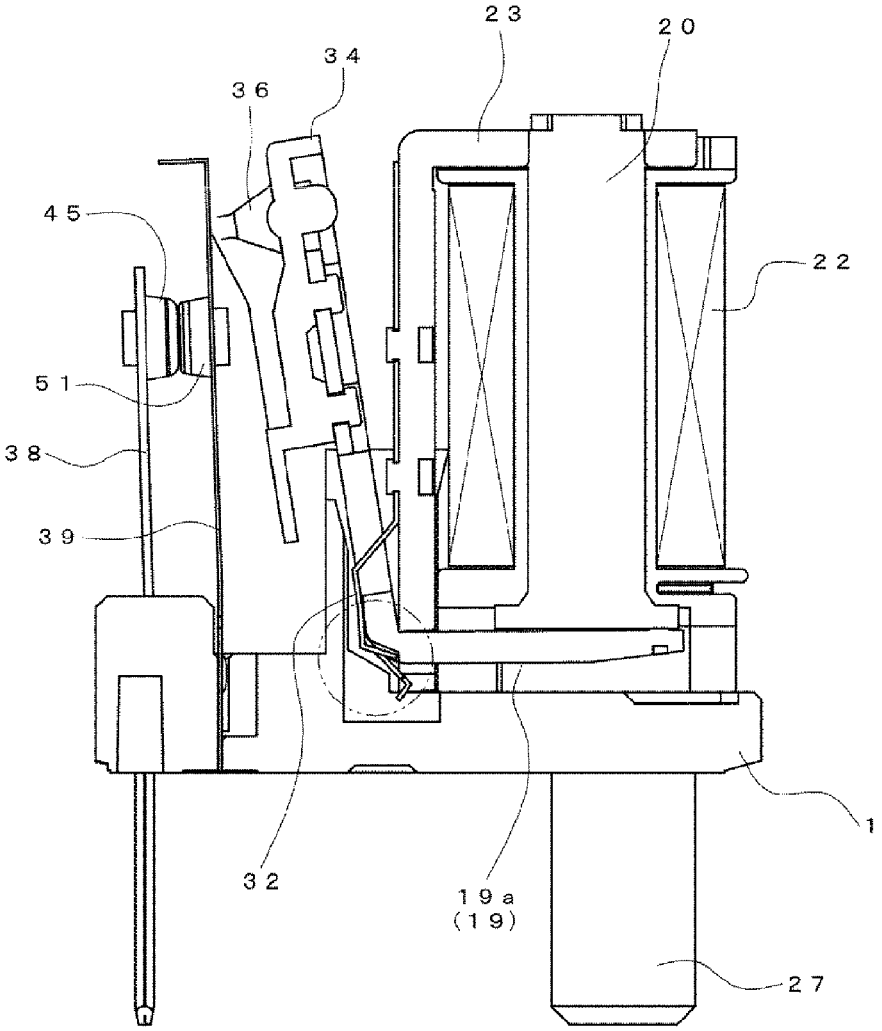
FIG. 12A is a front view in a state immediately after closing of the contacts where the movable touch piece has been driven from the state of FIG. 11.
Figure 12B:
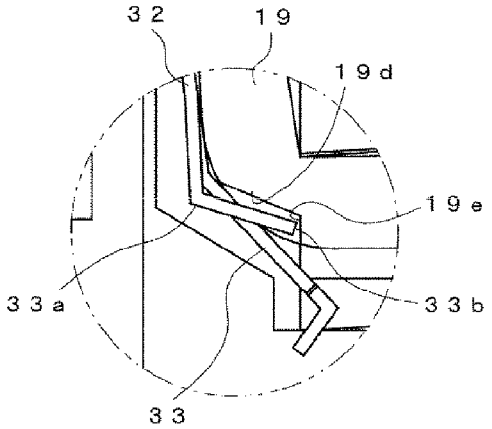
FIG. 12B is a partially enlarged view of FIG. 12A.

Thereafter, when the movable contact 51 moves onto the fixed contact 45 for closing (final driving period: cf. FIG. 12), driving force for the elastic force of the fixed touch piece 38 in addition to the elastic force of the movable touch piece 39 becomes necessary. In this state, the horizontal portion 19*a* of the movable iron piece 19 comes close to the suction surface 20*b* of the iron core 20, to allow sufficiently large suction force to be acted. Accordingly, the movable contact 51 is pressed onto the fixed contact 45, to allow desired contact pressure to be ensured.

As thus described, according to the electromagnetic relay in one or more embodiments of the present invention, making the press piece 33*a* of the hinge spring 32 act on the movable iron piece 19 enables suppression of force (driving force) required for driving the movable touch piece 39 at the stage where sufficient suction force cannot be acted in initial magnetization of the electromagnet 18. This allows smooth switch operations of the contacts.

Further, according to the electromagnetic relay in one or more embodiments of the present invention, even when impact force acts due to accidental dropping or the like, a defect such as deformation is not apt to occur since the elastic force from the press piece 33*a* of the hinge spring 32 is acting on the movable touch piece 39 via the card member 34 and the movable iron piece 19.

Other Embodiments

It is to be noted that the present invention is not restricted to the embodiments described above, but a variety of modifications can be made.

For example, although above, the hinge spring 32 is fixed to the yoke 23 and the press piece 33*a* thereof energizes the movable iron piece 19, the present invention is not limited thereto. In the following descriptions, constitutional parts corresponding to those above will be provided with the same numerals, and descriptions thereof will be omitted.

Figure 15:
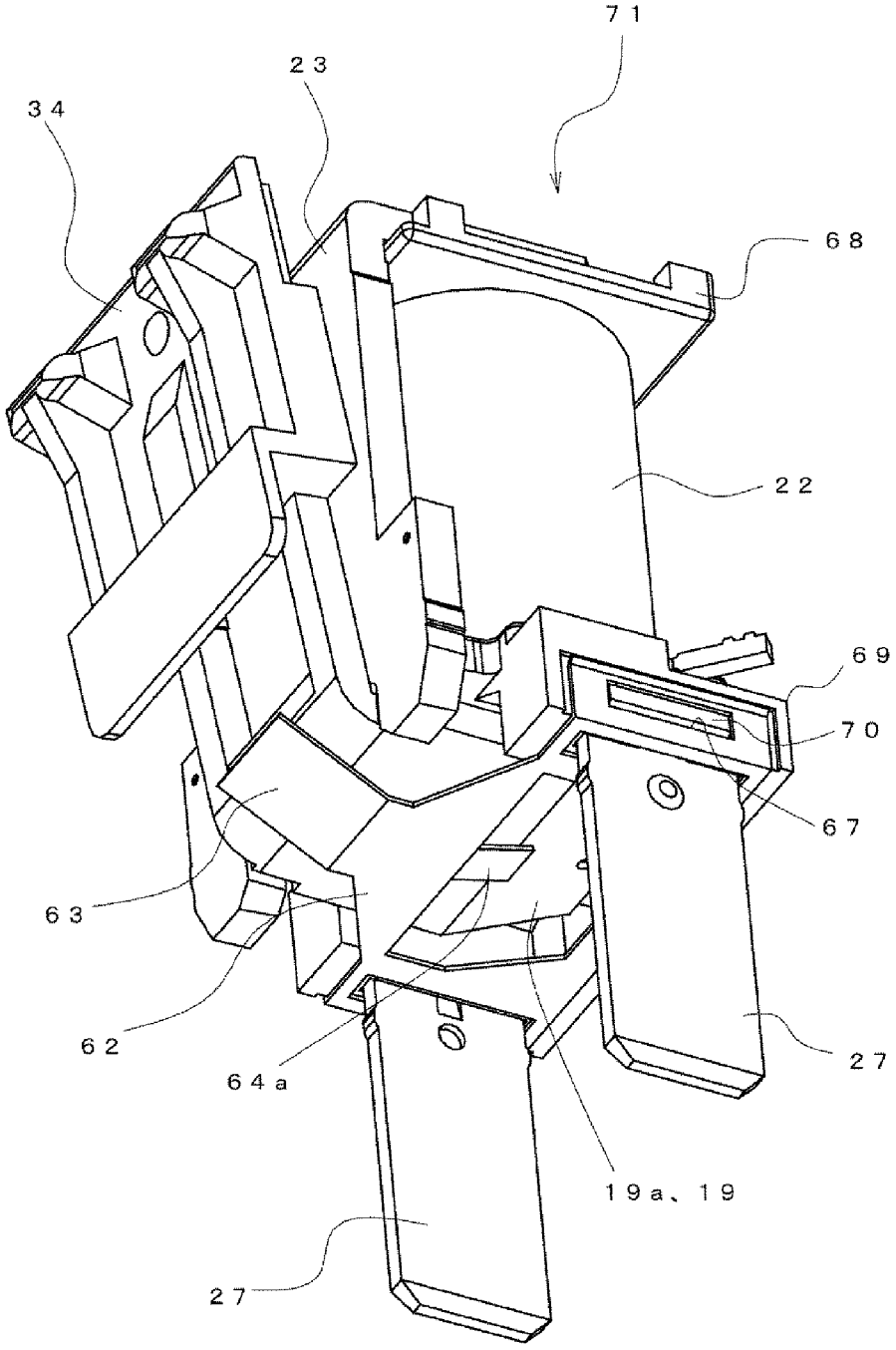
FIG. 15 is a perspective view showing an assembled state of each component of FIG. 14.

As shown in FIGS. 14 and 15, a hinge spring 61 is made up of a fitting surface portion 62 and an elastic piece portion 63.

The fitting surface portion 62 is formed with a trapezoidal opening 64 in the central portion thereof. A press piece 64*a* is extending obliquely upward from the central portion of one inner edge constituting the opening 64. This press piece 64*a* can be brought into press-contact with the horizontal portion 19*a* of the movable iron piece 19, and acts energization force via the movable iron piece 19 and the card member 34 so as to cancel elastic force of the movable touch piece 39. Further, each side of the fitting surface portion 62 is formed with a rectangular escape hole 65, through which the coil terminal 27 can be inserted. Moreover, a fitting piece 66 is extending upward at right angle from each end of the fitting surface portion 62. Each fitting piece 66 is formed with a rectangular fitting hole 67.

The elastic piece portion 63 is formed so as to extend from one side of the outer edge of the fitting surface portion 62, gradually narrow toward the central portion, and then protrude in parallel. The elastic piece portion 63 is in press-contact with the flexing portion of the movable iron piece 19, and supports this movable iron piece 19 rotatably around the lower end of the yoke 23 as a fulcrum.

Each side surface of a lower-side guard portion (suction-side guard portion) 69 of a spool 68 is formed with a latching protrusion portion 70 where the fitting hole 67 of the fitting piece 66 formed on the fitting surface portion 62 of the hinge spring 61 is to be latched.

After the coil 22 has been wound around the iron core 20 via the spool 68 and the coil terminal 27 has been press-fitted and fixed into the lower-side guard portion 69 of the spool 68 to complete an electromagnet 71, the hinge spring 61 with the above configuration is fitted from the lower side to the lower-side guard portion 69 of the spool 68. That is, the hinge spring 61 can be easily fitted by inserting the coil terminal 27 through the escape hole 65 of the hinge spring 61 and latching the latching protrusion portion 70 formed on each side surface of the lower-side guard portion 69 of the spool 68 into the fitting hole 67 of each fitting piece 66. The movable iron piece 19 is then arranged rotatably around the lower end of the yoke 23 as the fulcrum, and the flexing portion 33 is elastically supported by the press piece 64*a* of the hinge spring 61. According to one or more embodiments of the present invention, each constitutional component is assembled on the base 1, to complete the electromagnetic relay.

Figure 16A:
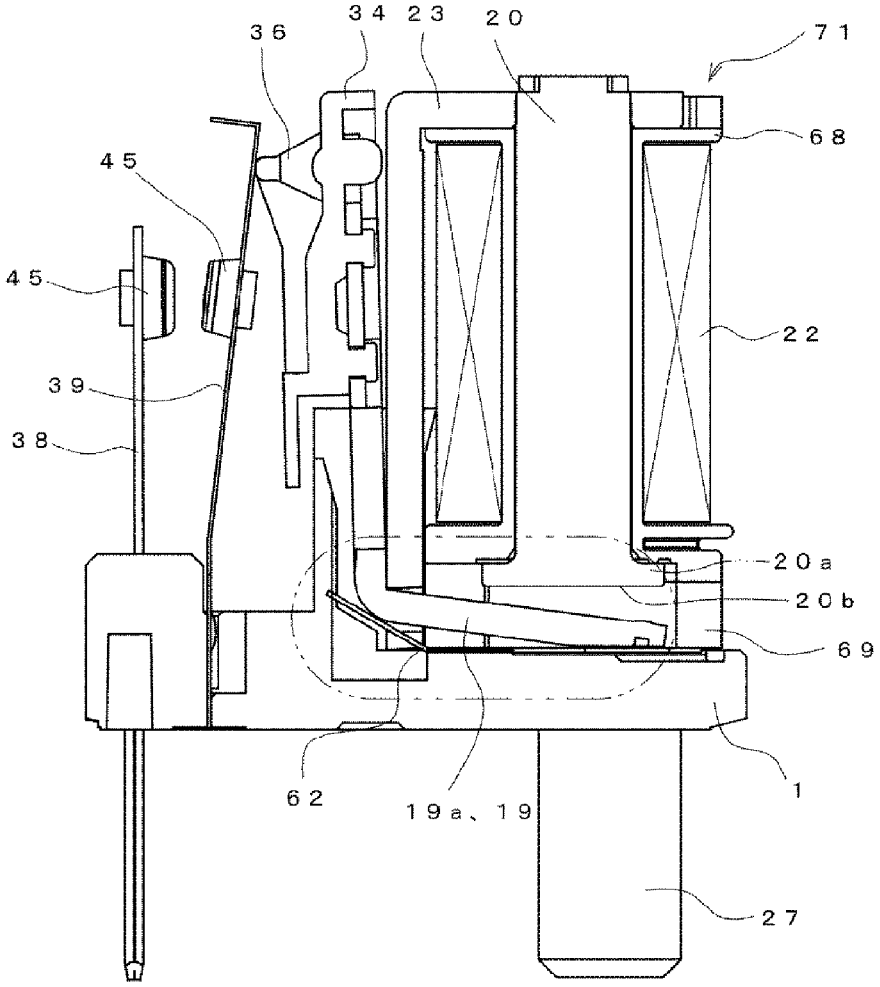
FIG. 16A is a front view of an electromagnetic relay according to one or more embodiments of the present invention, from which the casing has been removed, with the electromagnet being in a non-magnetized state.
Figure 16B:
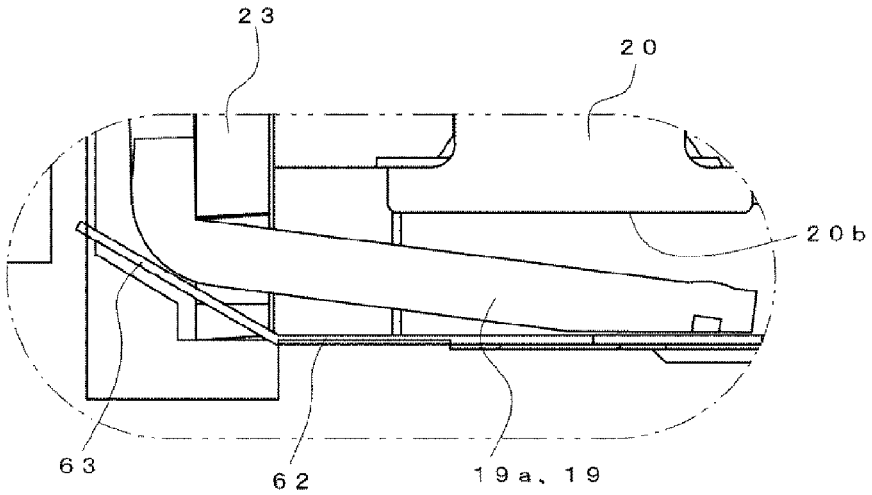
FIG. 16B is a partially enlarged view of FIG. 16A.

In the electromagnetic relay completed as thus described, when the electromagnet 71 not supplying a current to the coil 22 is in a demagnetized state, similar to the above, the movable iron piece 19 rotates clockwise (in FIG. 16) around the fulcrum by elastic force of the movable touch piece 39 which acts via the card member 34. At this time, the press piece 64*a* of the hinge spring 61, fitted to the lower-side guard portion 69 of the spool 68, comes into press-contact with the lower surface of the horizontal portion 19*a* of the movable iron piece 19. Accordingly, the horizontal portion 19*a* of the movable iron piece 19 is opposed to the suction surface 20*b* of the iron core 20 in the state where part of the elastic force of the movable touch piece 39 is cancelled.

Accordingly, similar to the above, in the initial driving period (cf. FIG. 16) when suction force cannot be sufficiently acted by the electromagnet 71 on the movable iron piece 19, initial driving force can be suppressed by energization force generated by the press piece 64*a* of the hinge spring 61.

Figure 17A:
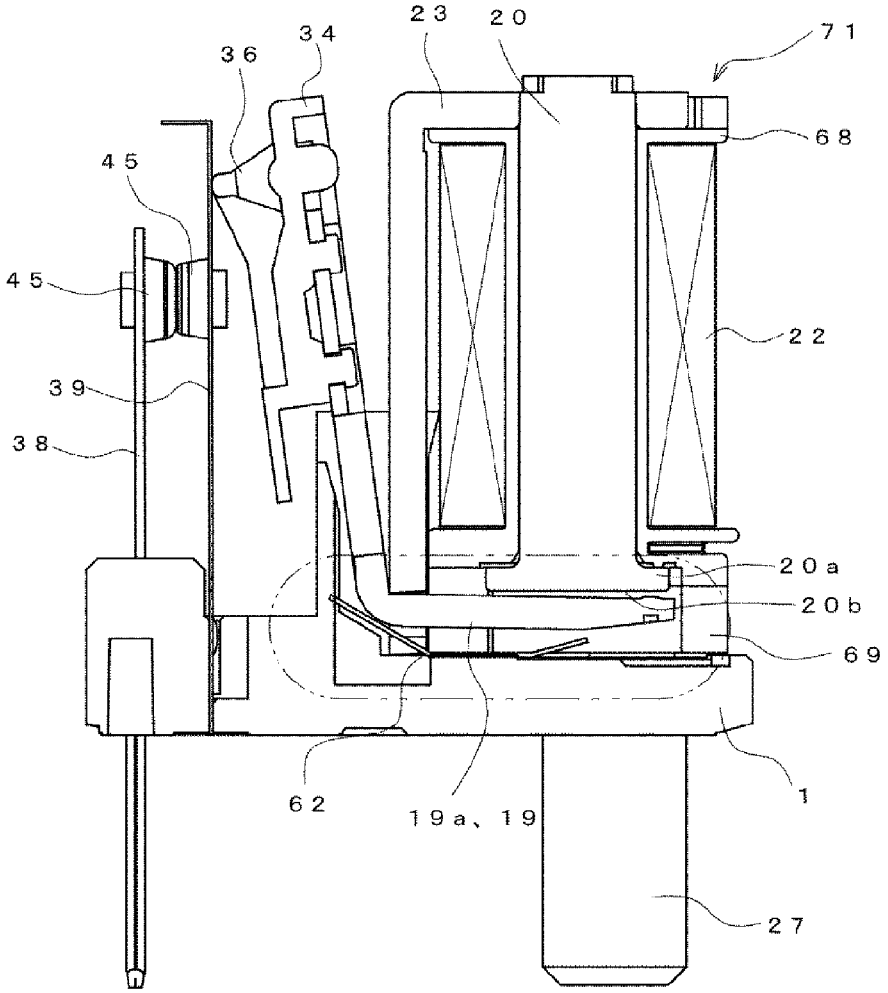
FIG. 17A is a front view showing a state immediately after closing of the contacts where the electromagnet has been magnetized from the state of FIG. 15.
Figure 17B:
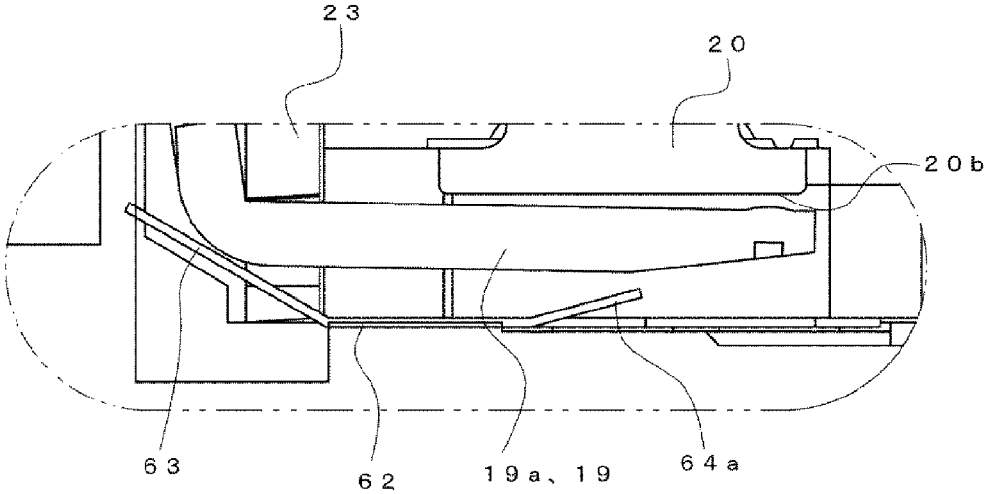
FIG. 17B is a partially enlarged view of FIG. 17A.

Further, in the intermediate driving period (cf. FIG. 17) when the movable touch piece 39 is driven and the energization force generated by the press piece 64*a* of the hinge spring 61 ceases to act, the horizontal portion 19*a* of the movable iron piece 19 comes close to the suction surface 20*b* of the iron core 20 to act sufficient suction force, and thereby allowing rotation of the movable iron piece 19 against elastic force of the movable touch piece 39.

Figure 18A:
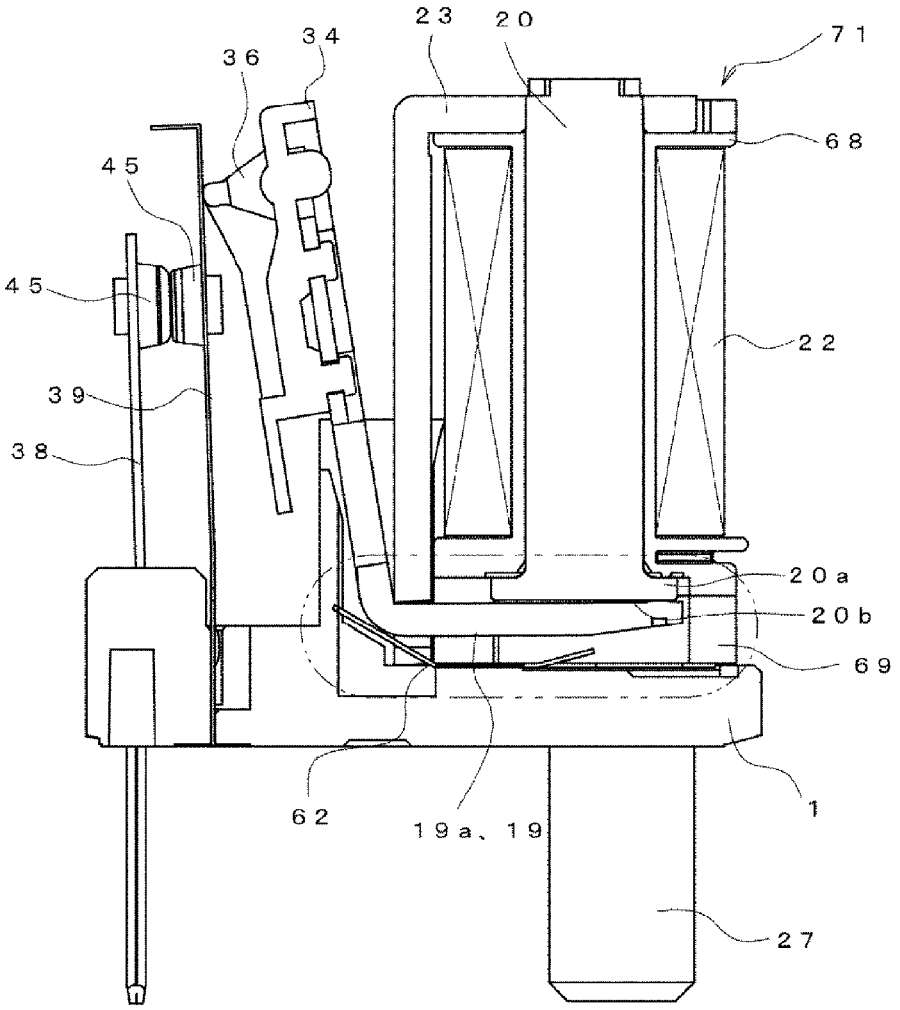
FIG. 18A is a front view in a state after closing of the contacts where the movable touch piece has been driven from the state of FIG. 16A.
Figure 18B:
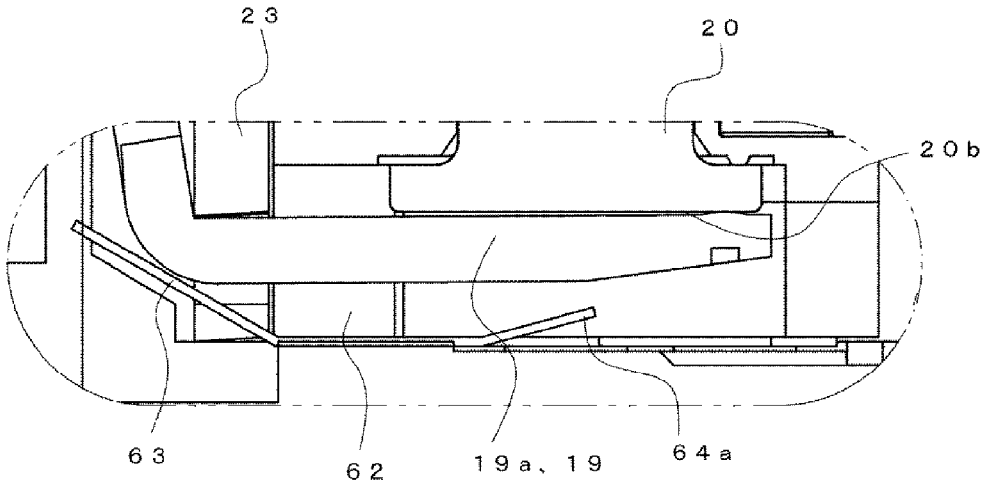
FIG. 18B is a partially enlarged view of FIG. 18A.

Moreover, in the final driving period (cf. FIG. 18) from the time when the movable contact 51 moves onto the fixed contact 45 for closing, the horizontal portion 19*a* of the movable iron piece 19 comes sufficiently close to the suction surface 20*b* of the iron core 20 to act even larger suction force, thereby allowing exertion of driving force against elastic force of both the movable touch piece 39 and the fixed touch piece 38.

As thus described, according to the electromagnetic relay according to one or more embodiments of the present invention, the hinge spring 61 can be easily fitted to the lower-side guard portion 69 of the spool 68. Further, it is the press piece 64*a* extending from the inner edge of the opening 64 that energizes the horizontal portion 19*a* of the movable iron piece 19. For this reason, elastic force to be acted on the movable iron piece 19 can be easily adjusted by just changing an inclined angle of the press piece 64*a*.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electromagnetic relay, comprising:

a fixed touch piece comprising a fixed contact;

a movable touch piece, comprising a movable contact contactably and separably opposed to the fixed contact, and configured to elastically deform;

an electromagnet;

an intermediate member that rotates based on magnetization and demagnetization of the electromagnet and elastically deforms the movable touch piece; and an energization unit that energizes the movable touch piece to the fixed contact piece side via the intermediate member, wherein the electromagnet comprises a spool comprising a guard portion on each end of a cylindrical body, an iron core inserted through a central hole of the body of the spool, a coil wound on a periphery of the body of the spool, and a yoke with one end thereof fastened and fixed to one end of the iron core and the other end thereof extending to the lateral side of the suction surface of the other end of the iron core, wherein one guard portion of the spool is a suction-side guard portion formed with a groove portion where the suction surface of the iron core is exposed, wherein the intermediate member comprises a sucked portion, rotatably supported by the other end of the yoke and contactably and separably opposed to the suction surface of the iron core, and a pressing portion configured to press the movable touch piece, and wherein the energization unit is fitted to the suction-side guard portion of the spool, and has a press piece configured to press the sucked portion of the intermediate member located in the groove portion.

2. The electromagnetic relay according to claim 1, wherein the electromagnet is formed by winding a coil around an iron core via a spool, fastening and fixing one end of a yoke to one end of the iron core while extending the other end of the yoke to the lateral side of the suction surface of the other end of the iron core, wherein the intermediate member comprises:

a sucked portion, rotatably supported by the other end of the yoke and contactably and separably opposed to the suction surface of the iron core, and comprising a pressure receiving portion, and a pressing portion configured to press the movable touch piece, and wherein the energization unit is made up of a hinge spring fixed to the yoke, and comprises a press piece configured to press the pressure receiving portion of the intermediate member.

3. An electromagnetic relay, comprising:

a fixed touch piece comprising a fixed contact;

a movable touch piece, comprising a movable contact contactably and separably opposed to the fixed contact, and configured to elastically deform;

an electromagnet;

an intermediate member that rotates based on magnetization and demagnetization of the electromagnet and elastically deforms the movable touch piece; and an energization unit that energizes the movable touch piece to the fixed contact piece side via the intermediate member, wherein the energization unit stops performing energization after closing of the contacts, wherein the electromagnet comprises a spool comprising a guard portion on each end of a cylindrical body, an iron core inserted through a central hole of the body of the spool, a coil wound on a periphery of the body of the spool, and a yoke with one end thereof fastened and fixed to one end of the iron core and the other end thereof extending to the lateral side of the suction surface of the other end of the iron core, wherein one guard portion of the spool is a suction-side guard portion formed with a groove portion where the suction surface of the iron core is exposed, wherein the intermediate member comprises a sucked portion, rotatably supported by the other end of the yoke and contactably and separably opposed to the suction surface of the iron core, and a pressing portion configured to press the movable touch piece, and wherein the energization unit is fitted to the suction-side guard portion of the spool, and has a press piece configured to press the sucked portion of the intermediate member located in the groove portion.

4. The electromagnetic relay according to claim 3, wherein the energization unit performs energization until the movable touch piece elastically deforms up to a predetermined position before closing of the contacts.

5. The electromagnetic relay according to claim 3, wherein the electromagnet is formed by winding a coil around an iron core via a spool, fastening and fixing one end of a yoke to one end of the iron core while extending the other end of the yoke to the lateral side of the suction surface of the other end of the iron core, wherein the intermediate member comprises:

a sucked portion, rotatably supported by the other end of the yoke and contactably and separably opposed to the suction surface of the iron core, and comprising a pressure receiving portion, and a pressing portion configured to press the movable touch piece, and wherein the energization unit is made up of a hinge spring fixed to the yoke, and comprises a press piece configured to press the pressure receiving portion of the intermediate member.

6. An electromagnetic relay, comprising:

a fixed touch piece comprising a fixed contact;

a movable touch piece, comprising a movable contact contactably and separably opposed to the fixed contact, and configured to elastically deform;

an electromagnet;

an intermediate member that rotates based on magnetization and demagnetization of the electromagnet and elastically deforms the movable touch piece; and an energization unit that energizes the movable touch piece to the fixed contact piece side via the intermediate member, wherein the energization unit performs energization until the movable touch piece elastically deforms up to a predetermined position before closing of the contacts, wherein the electromagnet comprises a spool comprising a guard portion on each end of a cylindrical body, an iron core inserted through a central hole of the body of the spool, a coil wound on a periphery of the body of the spool, and a yoke with one end thereof fastened and fixed to one end of the iron core and the other end thereof extending to the lateral side of the suction surface of the other end of the iron core, wherein one guard portion of the spool is a suction-side guard portion formed with a groove portion where the suction surface of the iron core is exposed, wherein the intermediate member comprises a sucked portion, rotatably supported by the other end of the yoke and contactably and separably opposed to the suction surface of the iron core, and a pressing portion configured to press the movable touch piece, and wherein the energization unit is fitted to the suction-side guard portion of the spool, and has a press piece configured to press the sucked portion of the intermediate member located in the groove portion.

7. The electromagnetic relay according to claim 6, wherein the electromagnet is formed by winding a coil around an iron core via a spool, fastening and fixing one end of a yoke to one end of the iron core while extending the other end of the yoke to the lateral side of the suction surface of the other end of the iron core, wherein the intermediate member comprises:

a sucked portion, rotatably supported by the other end of the yoke and contactably and separably opposed to the suction surface of the iron core, and comprising a pressure receiving portion, and a pressing portion configured to press the movable touch piece, and wherein the energization unit is made up of a hinge spring fixed to the yoke, and comprises a press piece configured to press the pressure receiving portion of the intermediate member.

* * * * *